United States Patent [19]

Holden et al.

[11] 4,188,081

[45] Feb. 12, 1980

[54] VACUUM CLEANER HOSE ASSEMBLY AND METHOD OF MAKING SAME

[75] Inventors: Homer N. Holden, Sylva; Ivan Gaster, Hazelwood, both of N.C.

[73] Assignee: Dayco Corporation, Dayton, Ohio

[21] Appl. No.: 912,906

[22] Filed: Jun. 5, 1978

[51] Int. Cl.[2] ..... H01R 3/04

[52] U.S. Cl. ..... 339/15; 339/16 R

[58] Field of Search ..... 339/15, 16 R

[56] References Cited

U.S. PATENT DOCUMENTS 4,012,091 3/1977 Westergren ..... 339/15

*Primary Examiner*—Roy Lake

*Assistant Examiner*—DeWalden W. Jones

[57] ABSTRACT

A vacuum cleaner hose assembly and method of making same are provided wherein such assembly comprises, an elongated vacuum hose having a hose end, a plurality of electrical conductors extending along the vacuum hose with each conductor having an end portion disposed immediately adjacent the hose end, a plurality of electrical connectors each fixed to an associated end portion of an associated conductor, a flexible hose fitting fixed to the hose end with the fitting having a plurality of the electrical connectors embedded therein which are movable with flexing movements of the fitting, a rigid hose adapter operatively connected to the fitting, an electrical device carried by the adapter and connected to the embedded connectors with the device having precisely aligned integral electrical connectors, and cooperating portions on the adapter and electrical device self positioning the electrical device relative to the adapter with the precisely aligned electrical connectors readily accessible for easy mating with cooperating electrical connectors.

28 Claims, 20 Drawing Figures

VACUUM CLEANER HOSE ASSEMBLY AND METHOD OF MAKING SAME

BACKGROUND OF THE INVENTION

Flexible vacuum hose assemblies made primarily of polymeric material are widely used particularly on so-called tank or canister type vacuum cleaners. In many applications, each of such hose assemblies is provided with dual purpose wires which serve as reinforcing wires preventing collapse of the vacuum hose and such wires also serve as electrical conductors whereby each hose assembly may be connected to a vacuum tank at one end and provided with an electric power driven cleaning tool at its opposite end.

It is common practice to make hose assemblies of the character mentioned with hose fittings which are usually molded in position around their vacuum hose and each fitting is often made of a comparatively pliable and flexible polymeric material which has electrical connectors embedded therein and such embedded connectors are fixed to associated dual purpose wires. However, because of the comparative rigidity of the dual purpose wires in each polymeric vacuum hose relative to each flexible hose fitting, electrical connectors fixed to such wires and embedded in an associated hose fitting are usually not precisely aligned and are movable with flexing of the hose fitting. In many applications where it is necessary to mate the embedded connectors with precisely aligned electrical connectors of an associated component being connected to the fitting having the embedded connectors therein, such mating is ordinarily very difficult and may result in damage to the electrical connectors as well as to such fitting and/or associated component requiring scrapping of damaged parts and resulting in unnecessary excessive costs.

SUMMARY

It is a feature of this invention to provide in a vacuum cleaner hose assembly of the type commonly made for a tank-type vacuum cleaner a hose adapter and electrical device carried thereby which may be easily installed on the hose assembly to provide a hose fitting having precisely aligned integral electrical connectors which are readily accessible for easy mating with cooperating electrical connectors.

Another feature of this invention is to provide a vacuum cleaner hose assembly which comprises, an elongated vacuum hose having a hose end, a plurality of electrical conductors extending along the vacuum hose with each conductor having an end portion disposed immediately adjacent the hose end, a plurality of electrical connectors each fixed to an associated end portion of an associated conductor, a flexible hose fitting fixed to the hose end with the fitting having a plurality of the electrical connectors embedded therein which are movable with flexing movements of the fitting, a rigid hose adapter operatively connected to the fitting, and electrical device carried by the adapter and connected to the embedded connectors with the device having precisely aligned integral electrical connectors, and cooperating portions on said adapter and electrical device self positioning the electrical device relative to the adapter with the precisely aligned electrical connectors readily accessible for easy mating with cooperating electrical connectors.

Another feature of this invention is to provide a vacuum cleaner hose assembly of the character mentioned in which the electrical device comprises a rigid support structure made of an electrical insulating material and the cooperating portions are defined by cooperating positioning surfaces on the support structure and on the adapter.

Another feature of this invention is to provide a vacuum cleaner hose assembly of the character mentioned in which the precisely aligned electrical connectors of the electrical device are molded in the support structure.

Another feature of this invention is to provide an improved method of making a vacuum cleaner hose assembly of the character mentioned.

Accordingly, it is an object of this invention to provide an improved vacuum cleaner hose assembly and method of making same having one or more of the novel features set forth above or hereinafter shown or described.

Other features, objects, details, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
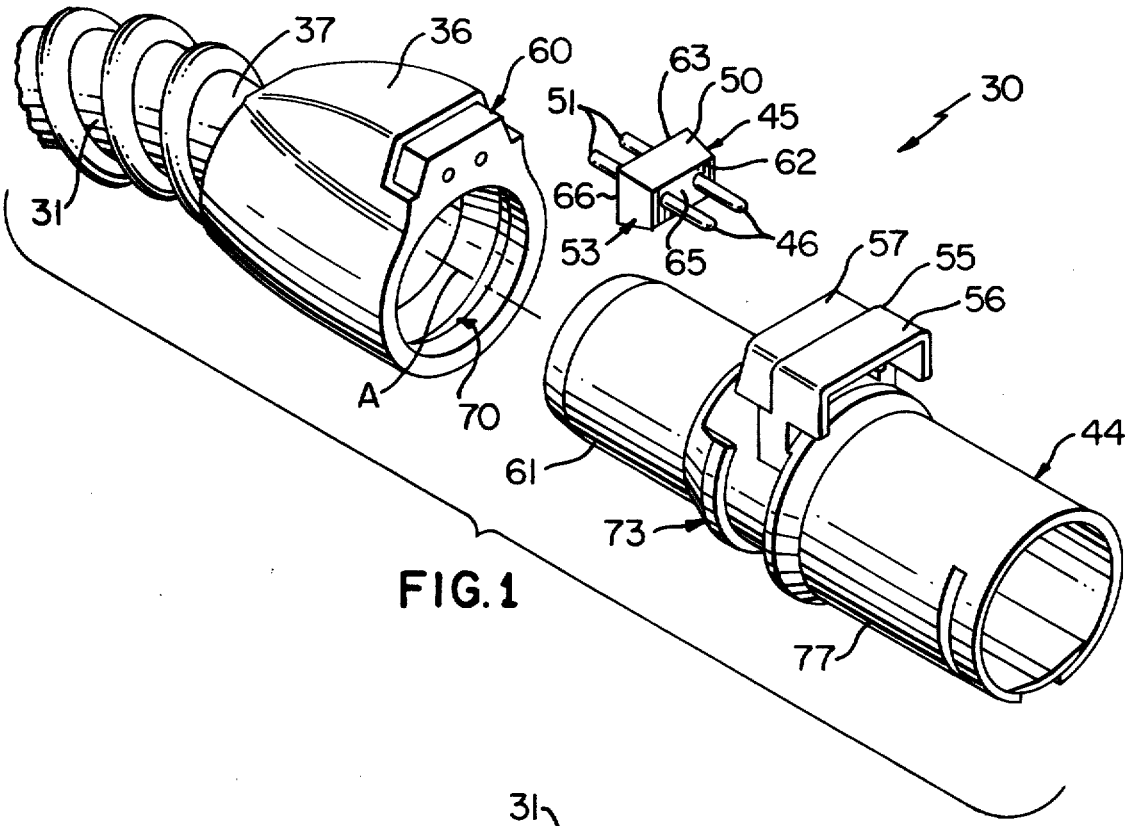
FIG. 1 is an exploded perspective view of one end portion of a vacuum cleaner hose assembly of this invention particularly illustrating a vacuum hose having a flexible hose fitting fixed thereto, an electrical device having precisely aligned integral electrical connectors, and a rigid hose adapter which is adapted to be connected to the hose fitting and carries the electrical device.
Figure 2:
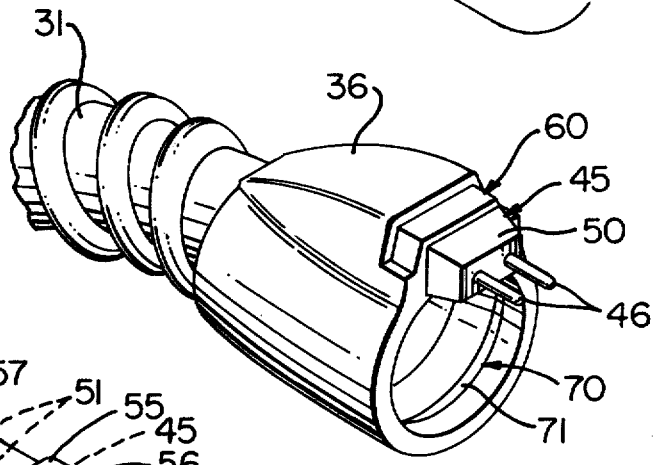
FIG. 2 is a fragmentary perspective view particularly illustrating the electrical device and hose fitting of FIG. 1 in assembled relation.
Figure 3:
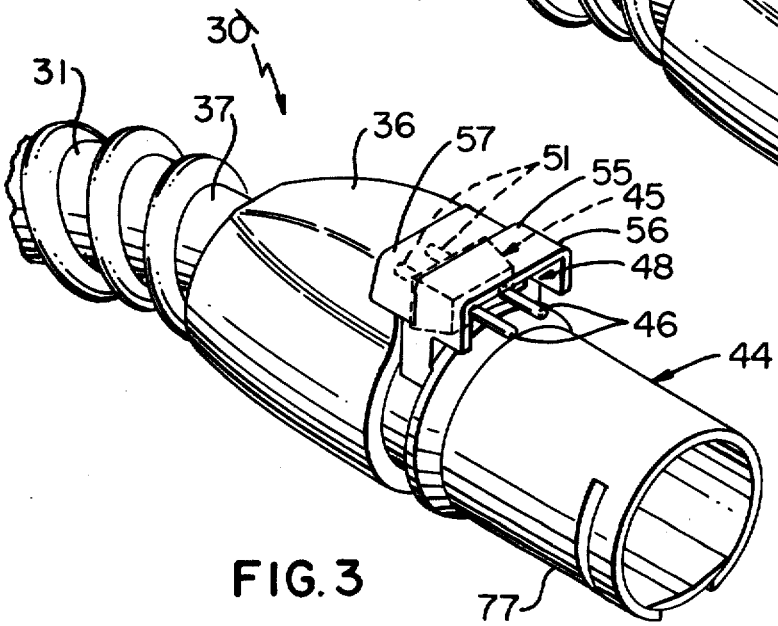
FIG. 3 is a fragmentary perspective view illustrating all three components of FIG. 1 in assembled relation.

Reference is now made to FIG. 1 of the drawings which is an exploded perspective view of components comprising one end portion of an exemplary embodiment of a vacuum cleaner hose assembly of this invention which is designated generally by the reference numeral 30. The opposite end portion of such hose assembly 30 is identical to the end portion illustrated in FIG. 1 and thus will not be shown and/or described. The vacuum cleaner hose assembly 30 is of the type employed in a vacuum cleaner apparatus which has a canister or tank and which may have a suitable vacuum tube or the like extending therefrom and which is particularly adapted to have the illustrated end portion of the hose assembly 30 connected thereto.

Figure 4:
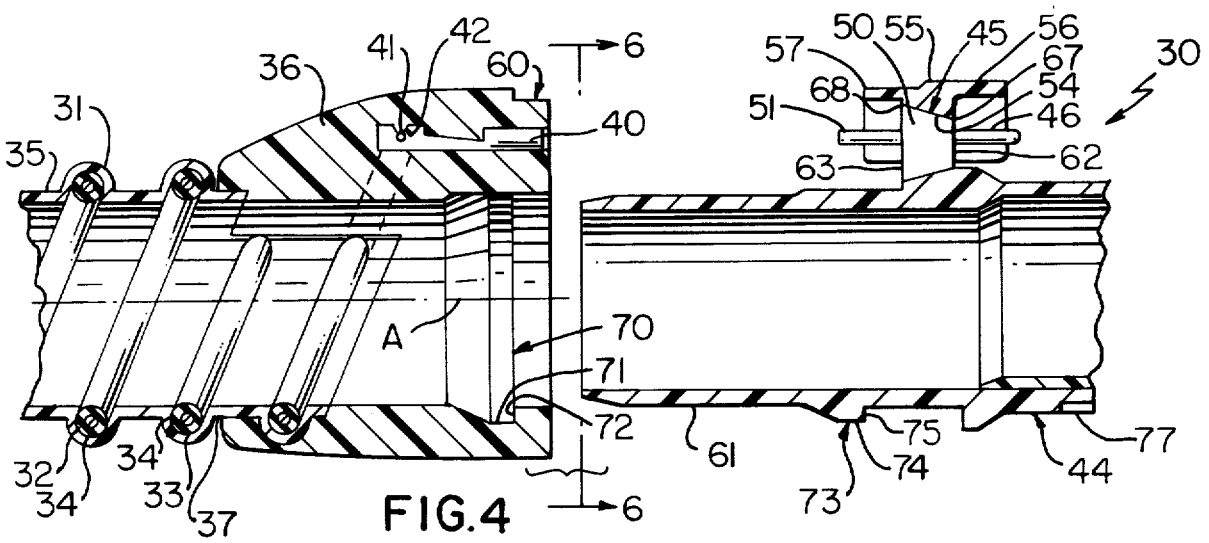
FIG. 4 is a fragmentary view illustrating the electrical device and hose adapter of FIG. 1 in assembled relation with the adapter in cross section and the electrical device in elevation and also illustrating the hose fitting and its associated end portion of the vacuum hose in cross section.
Figure 5:
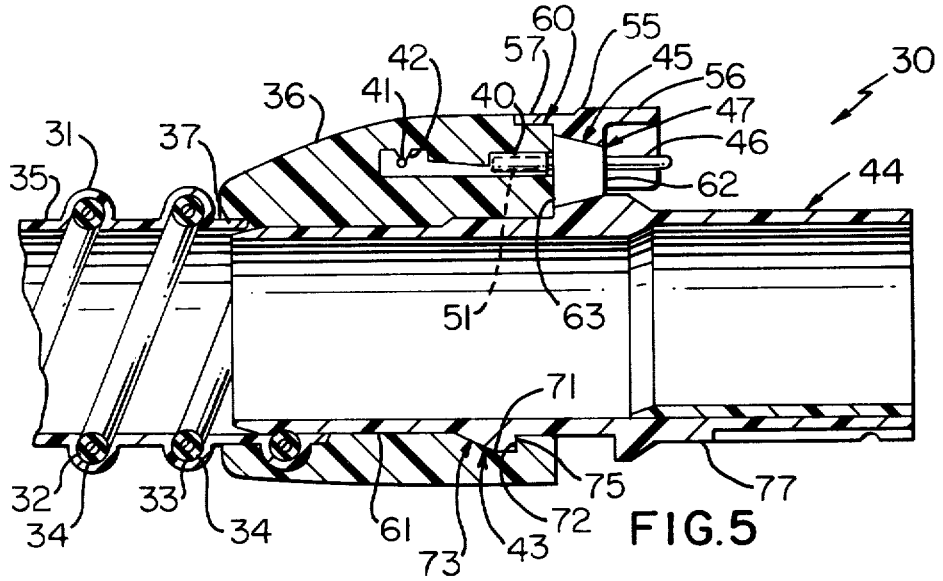
FIG. 5 is a view of the assembled components of FIG. 3 showing the vacuum hose fitting and hose adapter in cross section and the electrical device in elevation.
Figure 6:
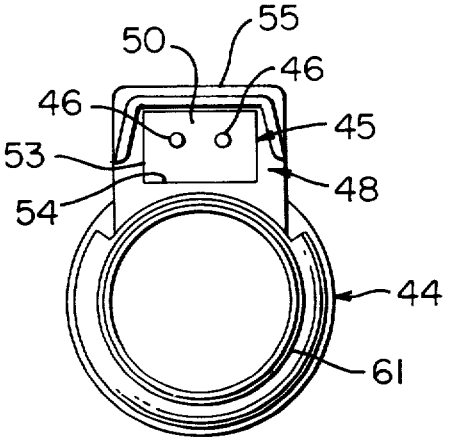
FIG. 6 is a view taken essentially on the line 6—6 of FIG. 4.

The vacuum cleaner hose assembly 30 comprises an elongated vacuum hose 31 having a hose end as illustrated and a central longitudinal axis A, FIG. 4. The vacuum hose 31 has a plurality of two dual-purpose wires 32 and 33 which serve as reinforcing wires which assure that the vacuum hose 31 may be flexed during normal operations without collapse thereof and the wires 32 and 33 also serve as electrical conductors. Each wire 32 and 33 has an electrical insulating sleeve designated by the reference numeral 34 disposed therearound. The hose assembly 30 has its electrical conductor-reinforcing wires 32 and 33 extending in a helical pattern along and in supporting relation within the hose 31 and in particular such wires are disposed in supporting relation against the inside surface of the polymeric tube portion 35 of the vacuum hose 31.

The vacuum cleaner hose assembly 30 has a flexible hose fitting 36 fixed to the illustrated end 37 of hose 31 and such hose fitting may be defined using any suitable technique known in the art. Preferably such fitting is defined by molding such fitting in position around end portion 37 of the vacuum hose 31 and essentially as disclosed in U.S. Pat. No. 3,928,715, for example. Further, the reference to the hose fitting 36 being flexible is intended to define that such hose fitting is not rigid and may be compressed and bent yet the hose fitting is made of a resilient polymeric material such as a synthetic plastic material which enables such fitting to return essentially to its original unbent or unflexed condition.

In a similar manner as disclosed in the above-mentioned patent, the hose fitting 36 of the assembly 30 has a plurality of electrical connectors each designated by the same reference numeral 40 suitably embedded therein (with the polymeric material of the fitting 36 serving as a matrix therefor) and each connector 40 of FIGS. 1 through 6 is shown as a female connector and is fixed to an associated end portion of an associated conductor or wire, either 32 and 33. For simplicity and ease of description and presentation, each end portion of each dual-purpose wire 32 and 33 is designated by the reference numeral 41 and the electrical connector is fixed to its end portion employing a knife edge portion 42 thereof to provide a firm high-performance mechanical and electrical connection therebetween. With the hose fitting 36 being made of flexible yet resilient polymeric material, as described above, the embedded electrical connectors 40 are also movable with any flexing or other movement of the matrix portion of the fitting surrounding each connector and it will be appreciated that in applications where it is necessary to connect the fittings 40 with precisely positioned and comparatively rigidly placed electrical connectors, it is difficult and in many instances impossible to achieve a satisfactory electrical connection.

The vacuum cleaner hose assembly 30 has a rigid hose adapter 44 which is operatively connected to the hose fitting 36 and held in position by cooperating holding means in the adapter 44 and fitting 36 and such holding means is designated generally by the reference numeral 43 (FIGS. 3 and 5) and such holding means will be described in detail later. The hose assembly 30 also has an electrical device 45 which is carried by the adapter 44 and is connected to the electrical connectors 40 embedded in the hose fitting 36 and the device 45 has precisely aligned integral electrical connector means shown as a pair of male connectors 46. The rigid adapter 44 and electrical device 45 have cooperating means or portions designated generally by the reference numeral 47 which serve to self position the electrical device 45 relative to the adapter 44 with the precisely aligned electrical connectors 46 readily accessible as shown at 48 in FIGS. 3 and 6 for easy mating with cooperating electrical connector means.

The electrical device 45 comprises a rigid support structure 50 which is made of any suitable rigid electrical insulating material and it will be seen that the device 45 has cooperating electrical connectors in the form of male connectors 51 which are particularly adapted to be connected with the embedded female electrical connectors 40 of fitting 36.

As previously mentioned, the vacuum cleaner hose assembly 30 has cooperating means or portions 47 for self positioning the electrical device 45 relative to the adapter 44. The positioning means comprises a positioning surface 53 on the support structure 50 and a cooperating positioning surface 54 on the adapter 44. The adapter 44 has an upwardly projecting portion 55 which is defined as an integral part of the overall adapter 44 whereby the adapter 44 with its portion 55 is defined as a single-piece structure and the portion 55 has an overhanging U-shaped portion 56 for protecting the precisely aligned electrical connector means or male connectors 46 of the device 45 and a similar oppositely arranged U-shaped portion 57 disposed diametrically opposite portion 56 with portion 57 being received around a roughly U-shaped cutout 60 in the upper portion of the hose fitting 36.

Referring now to FIGS. 1 and 4 of the drawings, it is seen that the positioning surface 53 comprises an outside substantially frustopyramidal surface and the positioning surface 54 is a cooperating inside substantially frustopyramidal surface. The surfaces 53 and 54 comprise cooperating planar portions and such surfaces self align upon operatively connecting the adapter 44 to the flexible hose fitting 36. As the adapter 44 is connected to fitting 36 the cooperating male connectors 51 of the device 45 are connected to the embedded female connectors 40 and this is achieved simply by urging adapter 44 within the hose fitting 36 by urging tubular portion 61 of such adapter within the flexible hose fitting 36. The urging of adapter 44 is achieved by applying forces along the axis A whereby the cooperating frustopyramidal surfaces 53 and 54, in essence, self position.

In many instances the embedded connectors 40 may be inaccurately positioned within their supporting polymeric matrix material; however, in accordance with this invention as the adapter 44 is moved in position the connectors 51 provide a satisfactory electrical connection with connectors 40 and the precisely aligned electrical male connectors 46 remain rigidly held by their rigid support structure 50 and in their precisely aligned positions. Further, with the adapter 44 in position the connectors 46 are readily accessible for easy mating with cooperating electrical connectors of any associated hose fitting which is to be connected with the adapter 44.

As seen in FIGS. 1 and 4 of the drawings, the frustopyramidal surface 53 has spaced parallel edges 62 and 63 at its opposite ends each of substantially rectangular peripheral outline; and, the edges 62 and 63 are adjoined by substantially planar surface 65 and 66 respectively with the surfaces 65 and 66 being disposed in parallel relation. Similarly, the frustopyramidal surface 54 has spaced parallel edges 67 and 68 at its opposite ends also of substantially rectangular peripheral outline.

The flexible hose fitting 36 has integral holding means 70 provided as an integral part thereof for holding an associated hose fitting or component thereto and such means 70 comprises a groove 71 in fitting 36 which has an annular planar surface 72 defining same. The rigid adapter 44 also has integral holding means 73 provided as an integral part thereof for holding such adapter to an associated fitting such as fitting 36. The integral holding means 73 comprises a projection 74 on the portion 61 of adapter 44 and projection 74 has an annular planar surface 75. The holding means 70 and 73 define the previously described cooperating holding means 43.

The cooperating holding means 43 of the assembly 30 is brought into use by disposing tubular portion 61 of the rigid hose adapter 44 within the hose fitting 36 with projecting portion 74 installed within cooperating groove 71 of the hose fitting 36. As mentioned earlier, the fitting 36 is made of flexible and yieldable polymeric material so that it slightly expands radially outwardly of groove 71 to receive projection 73 within groove 71. As the projection 73 moves in position annular surface 75 thereof snap locks in position against annular surface 72 which serves as a holding-locking shoulder thereby holding the adapter 44 within the hose fitting 36. During this action the cooperating frustopyramidal surfaces 53 and 54 self align as described earlier. The projection 74 of holding means 73 may be of any suitable type and in this example of the invention, such locking projection extends around approximately 270° of the circumferential outline of the tubular portion 61 of the adapter 44 whereby projection 74 is absent over an approximately 90° arc at the top portion of adapter 44 with such 90° arc being symmetrically arranged with respect to a diametrical plane bisecting the adapter 44 and the upwardly extending projecting portion 55 thereof.

It will also be seen that the adapter 44 has a tubular male extension or portion 77 extending therefrom and such tubular portion is particularly adapted to be received within an associated cooperating structure such as a previously mentioned vacuum tube of a cannister or tank type vacuum cleaning apparatus or the like.

As indicated earlier, the substantially frustoconical surfaces 53 and 54 are self-aligning surfaces which serve to self align the precisely positioned male electrical connectors 46 of electrical device 45 for easy access as described earlier upon connecting the adapter 44 and electrical device 45 to the hose fitting 36 with its embedded electrical connectors 40. It is not necessary with this invention to bond or otherwise fix the electrical device 45 to the rigid adapter 44.

However, it will be appreciated that in some applications of this invention it may be desired to fix or attach device 45 in position. This fixing action may be provided employing adhesive means which may be in the form of separate adhesive material. It will be appreciated that any suitable adhesive material known in the art may be used for this purpose.

Other exemplary embodiments of the vacuum cleaner hose assembly of this invention are illustrated in FIGS. 8–9, 10–12, 14, and 15–17 of the drawings. The vacuum cleaner hose assemblies illustrated in FIGS. 8–9, 10–12, 14, and 15–17 are similar to the assembly 30; therefore, such assemblies will be designated by the reference numerals 30A, 30B, 30C and 30D respectively and component parts of each assembly which are similar to corresponding parts of the assembly 30 will be designated in the drawings by the same reference numerals as in the assembly 30 (whether or not such component parts are mentioned in the specification) followed by the associated letter designation either A, B, C or D, and not described again in detail. Only those component parts of each assembly which are substantially different from corresponding parts of the hose construction 30 will be designated by a new reference numeral also followed by the associated letter designation and described in detail.

Figure 7:
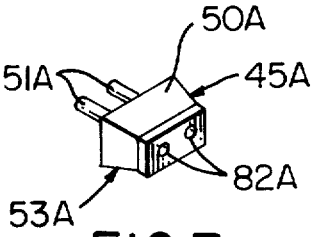
FIG. 7 is a perspective view illustrating another exemplary embodiment of an electrical device which has precisely aligned female electrical connector means instead of the male connector means illustrated in the electrical device of FIGS. 1–6.
Figure 8:
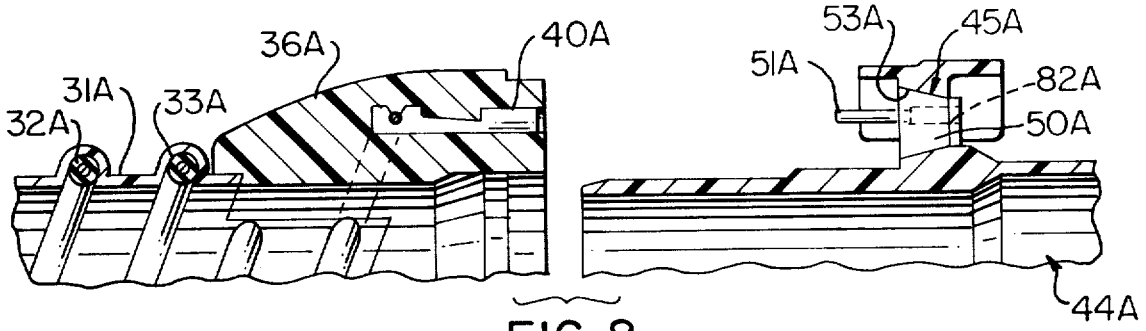
FIG. 8 is a cross-sectional view similar to the top half portion of FIG. 4 illustrating another embodiment of a hose assembly of this invention with the device of FIG. 7 installed in position in its rigid hose adapter.
Figure 9:
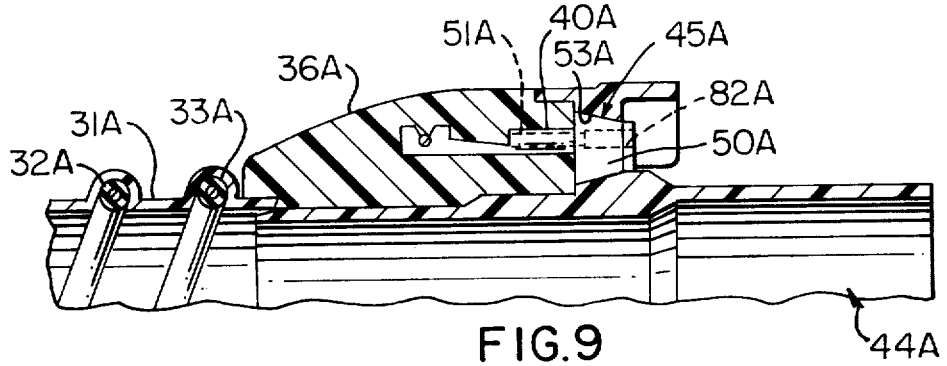
FIG. 9 is a view similar to the top half portion of FIG. 5 with the device of FIG. 7 in position.

The hose assembly 30A of FIGS. 8–9 has an elongated vacuum hose 31A provided with wires 32A–33A, a flexible hose fitting 36A provided with embedded female connectors 40A, a rigid adapter 44A, and an electrical device 45A which is shown in perspective view in FIG. 7. The device 45A has a frustopyramidal surface 53A and the adapter 44A has a cooperating frustopyramidal surface 54A with the surfaces 53A and 54A defining the cooperating self positioning means.

The electrical device 45A also has a rigid support structure 50A and cooperating male connectors 51A which are connected within the embedded connectors 40A.

The main difference between the hose assembly 30A and the hose assembly 30 is that the electrical device 45A has electrical connector means in the form of female electrical connectors 82A (instead of male connectors) which are readily accessible for easy mating with cooperating electrical connector means and in a similar manner as previously described.

Figure 10:
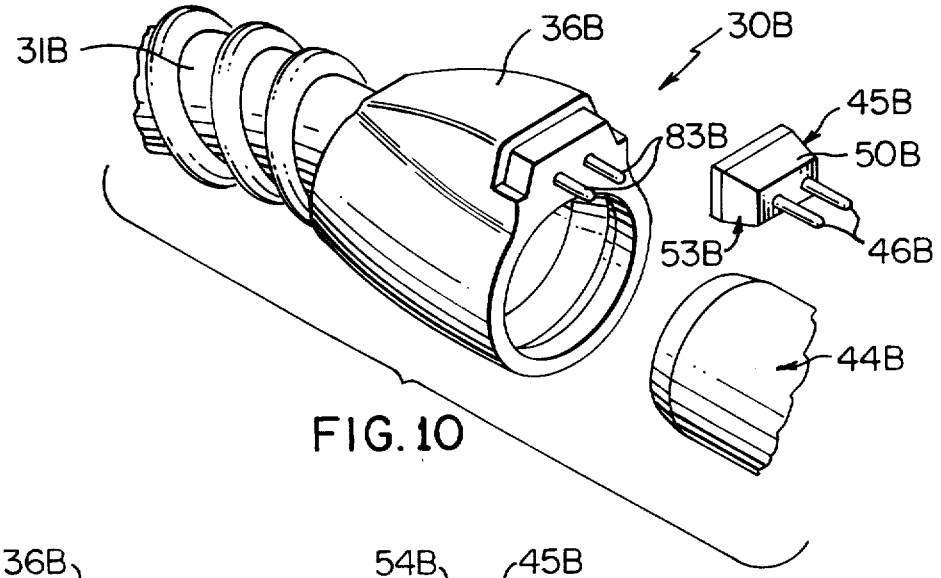
FIG. 10 is an exploded perspective view similar to FIG. 1 with portions broken away illustrating another embodiment of a hose assembly of this invention which uses another embodiment of an electrical device of this invention employed with a modified hose fitting.
Figure 11:
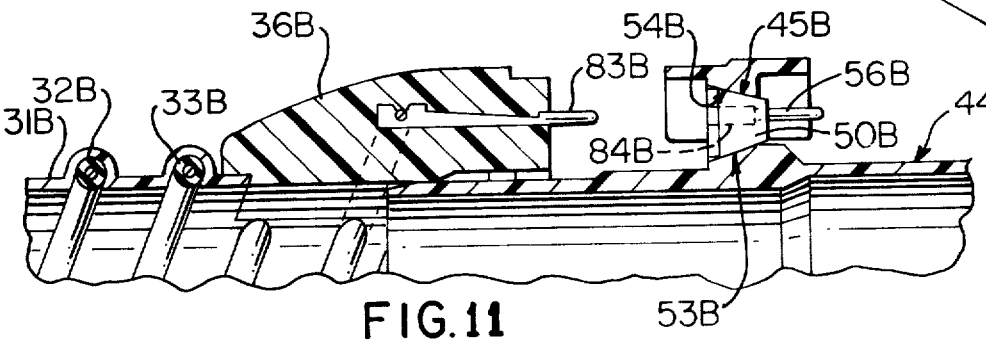
FIG. 11 is a view similar to FIG. 8 illustrating the electrical device of FIG. 10 installed within a rigid adapter and illustrating the adapter partially assembled in its hose fitting.
Figure 12:
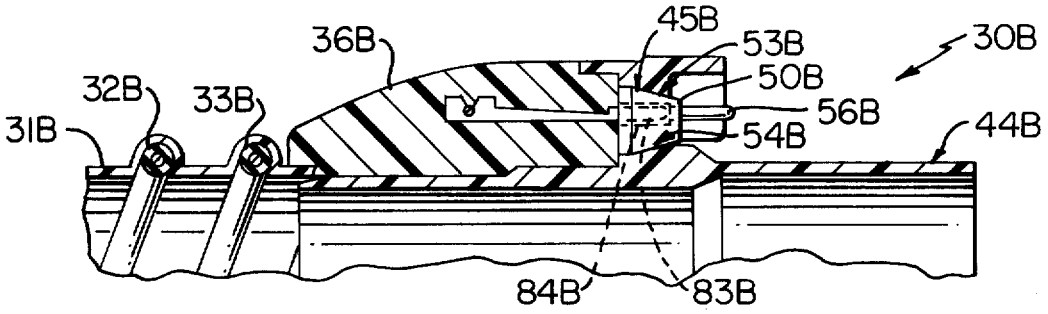
FIG. 12 is a view similar to FIG. 11 illustrating the components of FIG. 11 completely assembled.

The hose assembly 30B of FIGS. 10–12 has an elongated vacuum hose 31B provided with wires 32B–33B, a flexible hose fitting 36B provided with embedded electrical connectors, to be subsequently described, a rigid adapter 44B, and an electrical device 45B which is shown in perspective view in FIG. 10. The device 45B has a frustopyramidal surface 53B and the adapter 44B has a cooperating frustopyramidal surface 54B with the surfaces 53B and 54B defining cooperating self positioning means. The electrical device 45B also has a rigid support structure 50B and precisely aligned electrical connector means in the form of male connectors 46B which are similar to the connectors 46 of electrical device 45 of the hose assembly 30.

The main differences between the assembly 30B and the assembly 30 are that the flexible hose fitting 36B, instead of having a pair of female electrical connectors embedded therein, has a pair of male connectors 83B extending therefrom and the electrical device 45B has female electrical connector means 84B in the form of a pair of female electrical connectors 84B which are particularly adapted to receive male electrical connectors 83B upon operatively connecting the rigid hose adapter 44B within the flexible fitting 36B.

Figure 13:
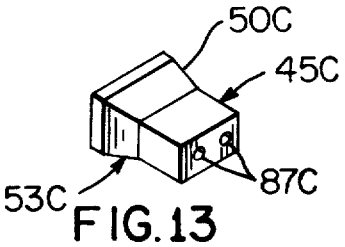
FIG. 13 is a view similar to FIG. 7 illustrating another exemplary embodiment of an electrical device of this invention which has female electrical connectors provided at both of its opposite ends.
Figure 14:
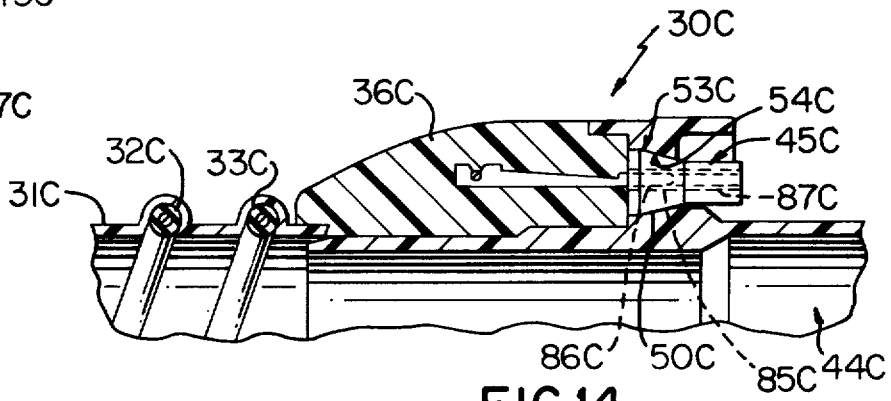
FIG. 14 is a view similar to FIG. 12 illustrating another embodiment of a hose assembly with the electrical device of FIG. 13 installed in position.

The hose assembly 30C of FIG. 14 has an elongated vacuum hose 31C provided with wires 32C–33C, a flexible hose fitting 36C provided with embedded electrical connectors to be subsequently described, a rigid adapter 44C, and an electrical device 45C which is shown in perspective view in FIG. 13. The electrical device 45C has a frustopyramidal surface 53C and the adapter 44C has a cooperating frustopyramidal surface 54C with the surfaces 53C and 54C defining cooperating self-positioning means as previously described. The electrical device 45C also has a rigid support structure 50C and precisely aligned electrical connector means.

The main differences between the hose assembly 30C and the hose assembly 30 are that the electrical device 45C has female electrical connectors in the form of a pair of female electrical connectors 85C which are particularly adapted to receive male electrical connectors 86C having base portions embedded in the flexible fitting 36C. In addition, the electrical device 45C also has electrical connector means in the form of female electrical connectors 87C (instead of male connectors) and the female connectors 87C are readily accessible for easy mating with cooperating electrical connector means and in a similar manner as previously described. As indicated above, the flexible hose fitting 36C instead of having a female electrical connectors therein, has a pair of embedded electrical connectors which have male connectors 86C. The connectors 86C are received within the electrical connectors 85C upon operatively connecting the rigid hose adapter 44C to the flexible fitting 36C.

Figure 15:
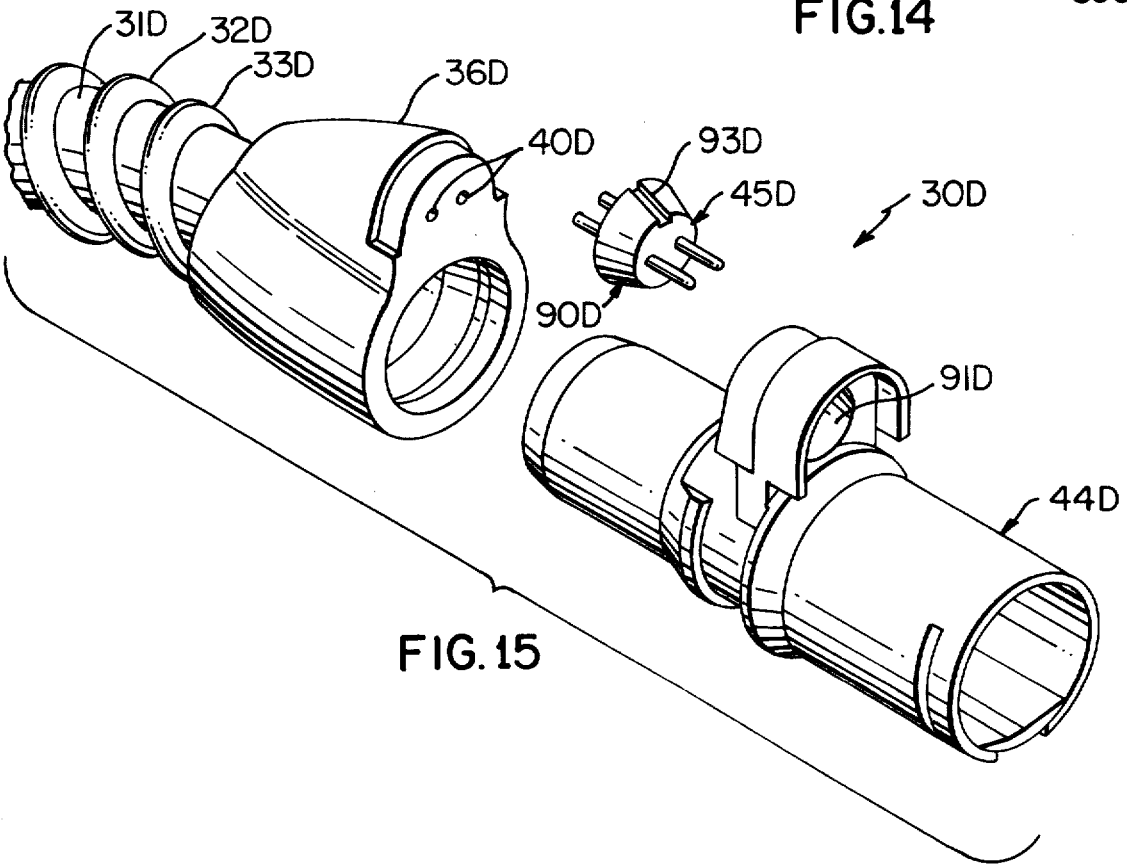
FIG. 15 is a view similar to FIG. 1 illustrating another exemplary embodiment of a vacuum cleaner hose assembly of this invention.
Figure 16:
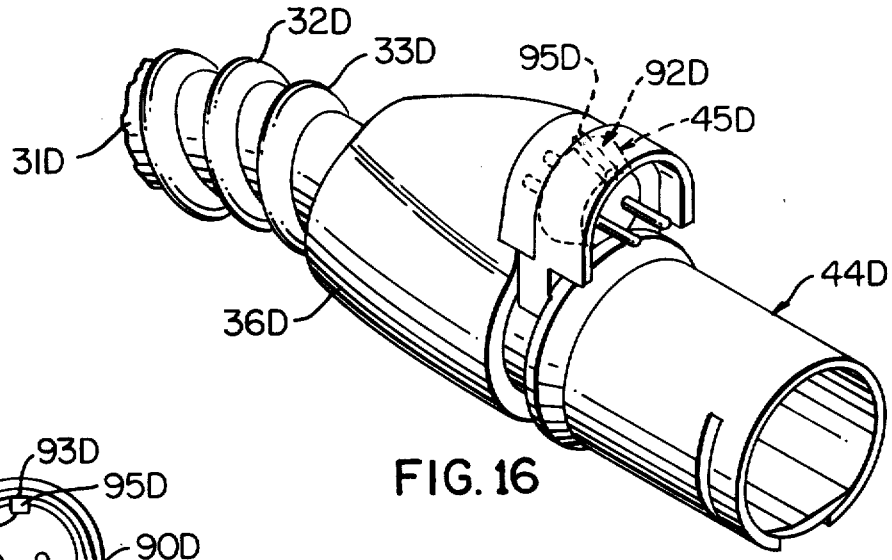
FIG. 16 is a view similar to FIG. 3 of the assembled vacuum cleaner hose assembly of FIG. 15.
Figure 17:
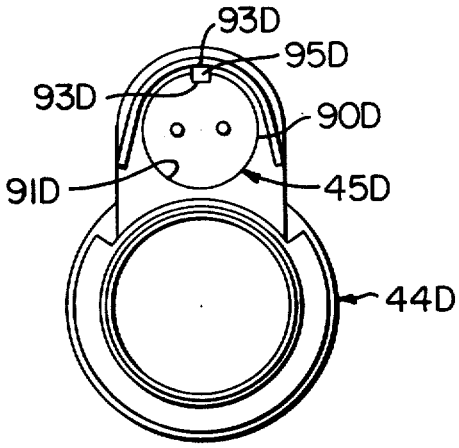
FIG. 17 is a view similar to FIG. 6 looking perpendicularly toward the assembled electrical device and hose adapter of FIG. 15 with the device and adapter detached from their associated hose fitting.

The hose assembly 30D of FIGS. 15–17 has an elongated vacuum hose 31D provided with wires 32D–33D, a flexible hose fitting 36D provided with embedded female connectors 40D, a rigid adapter 44D, and an electrical device 45D which is shown in exploded perspective view in FIG. 15. The device 45D has a frustoconical surface 90D and the adapter 44D has a cooperating frustoconical surface 91D with the surfaces 90D–91D defining cooperating self-positioning means or self-positioning portions or surfaces and in a similar manner as previously described for similar surfaces 53 and 54 of the hose assembly 30.

The hose assembly 30D also has antirotation means designated generally by the reference numeral 92D which prevents relative rotation between surfaces 90D–91D. The antirotation means is disposed between the frustoconical surfaces 90D–91D and such means may comprise cooperating keyways 93D and 94D in the components 45D and 44D respectively and a key 95D disposed between the cooperating keyways 93D–94D.

The hose assembly 30D has antirotation means 92D because rotation is possible between the frustoconical surfaces 90D and 91D. However, each of the hose assemblies 30, 30A, 30B, and 30C employs associated electrical devices which have frustopyramidal surfaces and the associated rigid adapters also have cooperating frustopyramidal surfaces whereby a self positioning action is possible yet without rotation between the cooperating frustopyramidal surfaces.

Figure 19:
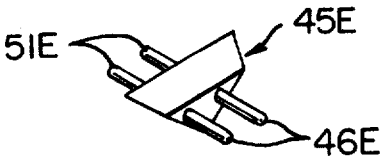
FIG. 19 illustrates another exemplary embodiment of an electrical device which may be used in associated hose assemblies in lieu of previously illustrated electrical devices.

Each of the vacuum hose assemblies 30, 30A, 30B and 30C employs respective electrical devices 45, 45A, 45B, and 45C with each of these electrical devices having frustopyramidal surfaces and each frustopyramidal surface has spaced parallel edges at its opposite ends of rectangular peripheral outline. Each rigid adapter associated with each of these electrical devices has similar cooperating frustopyramidal surfaces. However, it will be appreciated that each electrical device instead of having a frustopyramidal surface with spaced parallel edges of rectangular peripheral outline may have a frustopyramidal surface 53E with spaced parallel edges of triangular outline and a typical device of this type is illustrated in FIG. 19 and designated by the reference numeral 45E. The device 45E may be provided with male connectors 51E to be received within associated female connectors embedded in an associated hose fitting and similarly the electrical device 45E may be provided with precisely positioned male electrical connectors 46E which are precisely aligned.

Figure 20:
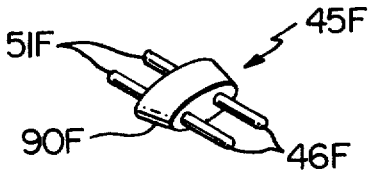
FIG. 20 illustrates still another exemplary embodiment of an electrical device which may be used in associated hose assemblies in lieu of previously illustrated electrical devices.

The vacuum hose assembly 30D employs an electrical device 45D having a frustoconical surface and the frustoconical surface has spaced parallel edges at its opposite ends of circular peripheral outline. The rigid adapter associated with device 45D has a similar cooperating frustoconical surface. However, it will be appreciated that the electrical device 45D instead of having a frustoconical surface with spaced parallel edges of circular peripheral outline may have a frustoconical surface 90F with spaced parallel edges of noncircular or elliptical outline and a typical device of this type is illustrated in FIG. 20 and designated by the reference numeral 45F. The device 45F may be provided with male connectors 51F to be received within associated female connectors embedded in an associated hose fitting and similarly the electrical device 45F may be provided with precisely positioned male electrical connectors 46F which are precisely aligned.

Figure 18:
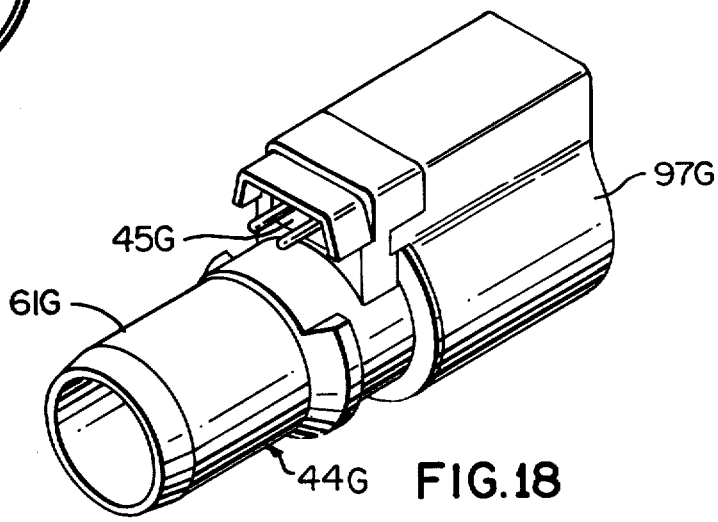
FIG. 18 is a perspective view of another exemplary embodiment of a hose adapter and integral electrical device assembled therewithin wherein such hose adapter has a female hose fitting extending therefrom.

The rigid adapter 44 of the assembly 30 has a tubular extension 77 extending therefrom which is in the form of a male tubular extension. However, it will be appreciated that the adapter of this invention need not necessarily be made in this manner. For example, the rigid adapter 44G of FIG. 18 has a tubular extension 61G which is to be received within an associated fitting, an electrical device 45G, and a female connector 97G at the end opposite from the tubular projection 61G.

The members 44 and 44A–D are shown of similar construction for ease of presentation; however, it will be appreciated that these members may be suitable modified to meet electrical safety codes.

In this disclosure the various components are cross-hatched in the drawings as made of synthetic plastic material; however, such components may be made of any suitable electrical insulating polymeric material, such as rubber for example.

It will also be appreciated that the rigid support structure of each electrical device may be any suitable electrical insulating material.

While present exemplary embodiments of this invention, and methods of practicing the same, have been illustrated and described, it will be recognized that this invention may be otherwise variously embodied and practiced within the scope of the following claims.

What is claimed is:

1. In a vacuum cleaner hose assembly comprising; an elongated vacuum hose having a hose end and a central longitudinal axis; a plurality of electrical conductors extending along said vacuum hose with each conductor having an end portion disposed immediately adjacent said hose end; a plurality of electrical connectors each fixed to an associated end portion of an associated conductor, and a flexible hose fitting fixed to said hose end and formed substantially as an integral part thereof with said fitting having a plurality of said electrical connectors embedded therein which are movable with flexing movements of said fitting; the improvement comprising; a rigid hose adapter operatively connected to said fitting, an electrical device carried by said adapter and connected to said embedded connectors, said device having precisely aligned integral electrical connector means, said device comprising a rigid support structure made of an electrical insulating material, and means positioning the electrical device relative to said adapter with said precisely aligned electrical connector means readily accessible for easy mating with cooperating electrical connector means, said positioning means comprising a positioning surface on said support structure and a cooperating surface on said adapter, said surfaces being self-aligning surfaces which self align upon connecting said adapter and electrical device to said fitting and embedded connectors.

2. In a vacuum hose cleaner assembly as set forth in claim 1 wherein said flexible hose fitting has means for holding an associated hose fitting thereto the further improvement wherein said adapter has said associated hose fitting provided as a part thereof and said adapter has cooperating holding means which engages said holding means, said holding means and cooperating holding means serving to hold said electrical device in position.

3. In a vacuum cleaner hose assembly as set forth in claim 2 the further improvement wherein said holding means and cooperating holding means comprise a holding shoulder comprising a groove in said fitting and a surface comprising a projection of said adapter, said holding means and cooperating holding means being the sole means holding said electrical device in position.

4. In a vacuum cleaner hose assembly as set forth in claim 1 the further improvement in which said surfaces comprise at least parts of cooperating planar portions.

5. In a vacuum cleaner hose assembly as set forth in claim 1 the further improvement comprising means fixing said surfaces together.

6. In a vacuum cleaner hose assembly as set forth in claim 1 the further improvement in which said surfaces comprise an outside substantially frustopyramidal surface on said support structure defining said positioning surface and an inside substantially frustopyramidal surface on said adapter defining said cooperating surface.

7. In a vacuum cleaner hose assembly as set forth in claim 1 the further improvement in which said surfaces comprise an outside substantially frustoconical surface on said support structure defining said positioning surface and an inside substantially frustoconical surface on said adapter defining said cooperating surface.

8. In a vacuum cleaner hose assembly as set forth in claim 7 the further improvement comprises means disposed between said frustoconical surfaces preventing relative rotation therebetween.

9. In a vacuum cleaner hose assembly as set forth in claim 2 the further improvement in which said device further comprises cooperating electrical connectors operatively connected to said embedded connectors, said embedded connectors, cooperating connectors, and electrical connector means being disposed substantially parallel to said axis.

10. In a vacuum cleaner hose assembly as set forth in claim 6 the further improvement in which each of said frustopyramidal surfaces has spaced parallel edges at its opposite ends of rectangular peripheral outline.

11. In a vacuum cleaner hose assembly as set forth in claim 6 the further improvement in which each of said frustopyramidal surfaces has spaced parallel edges at its opposite ends of triangular peripheral outline.

12. In a vacuum cleaner hose assembly as set forth in claim 7 the further improvement in which each of said frustoconical surfaces has spaced parallel edges at its opposite ends of circular peripheral outline.

13. In a vacuum cleaner hose assembly as set forth in claim 7 the further improvement in which each of said frustoconical surfaces has spaced parallel edges at its opposite ends of roughly elliptical peripheral outline.

14. In a vacuum cleaner hose assembly as set forth in claim 9 the further improvement in which said embedded connectors comprise female connectors and said cooperating connectors comprise male connectors.

15. In a vacuum cleaner hose assembly as set forth in claim 14 the further improvement in which said electrical connector means comprises male connectors.

16. In a vacuum cleaner hose assembly as set forth in claim 14 the further improvement in which said electrical connector means comprises female connectors.

17. In a vacuum cleaner hose assembly as set forth in claim 9 the further improvement in which said embedded connectors comprise male connectors and said cooperating connectors comprise female connectors.

18. In a vacuum cleaner hose assembly as set forth in claim 17 the further improvement in which said electrical connector means comprise male connectors.

19. In a vacuum cleaner hose assembly as set forth in claim 17 the further improvement in which said electrical connector means comprise female connectors.

20. In a vacuum cleaner hose assembly as set forth in claim 1 wherein said flexible hose fitting is a female hose fitting the further improvement wherein said rigid hose adapter has a male hose fitting extending therefrom.

21. In a vacuum cleaner hose assembly as set forth in claim 1 wherein said flexible hose fitting is a female hose fitting the further improvement in which said rigid hose adapter has a female fitting extending therefrom.

22. In a vacuum cleaner hose assembly as set forth in claim 1 wherein said flexible hose fitting is made of a polymeric material the further improvement in which said hose adapter is also made of a polymeric material.

23. In a vacuum cleaner hose assembly as set forth in claim 1 the further improvement in which said electrical conductors comprise dual purpose conductors and reinforcing members for said hose assembly.

24. In a method of making a vacuum cleaner hose assembly comprising the steps of; fabricating an elongated vacuum hose having a hose end and a central longitudinal axis; disposing a plurality of electrical conductors along said vacuum hose with each conductor having an end portion disposed immediately adjacent said hose end; fixing a plurality of electrical connectors to said conductors with each connector being fixed to an associated end portion of an associated conductor; and molding a flexible hose fitting to said hose end substantially as an integral part thereof with said fitting having a plurality of said electrical connectors embedded therein which are movable with flexing movement of said fitting; the improvement comprising the further method steps which enable said assembly to be used in applications requiring precisely positioned electrical connector means; said further method steps comprising; forming a rigid hose adapter, constructing an electrical device which has cooperating electrical connectors and precisely aligned integral electrical connector means, providing said electrical device and adapter with cooperating self-positioning means, and operatively connecting said adapter to said fitting to thereby connect said cooperating connectors to said embedded connectors and cause said cooperating self-positioning means to align said electrical connector means for easy accessibility and mating with cooperating electrical connector means.

25. In a method of making a vacuum cleaner hose assembly as set forth in claim 24 the further improvement in which said constructing step comprises the step of constructing said electrical device of a rigid support structure made of an electrical insulating material and wherein said providing step comprises providing said electrical device and adapter with cooperating positioning surfaces which define said self-positioning means.

26. In a method of making a vacuum cleaner hose assembly as set forth in claim 25 the further improvement in which said providing step comprises providing said cooperating positioning surfaces as cooperating frustopyramidal surfaces.

27. In a method of making a vacuum cleaner hose assembly as set forth in claim 25 the further improvement in which said providing step comprises providing said cooperating positioning surfaces as cooperating frustoconical surfaces.

28. In a method of making a vacuum cleaner hose assembly as set forth in claim 25 the further improvement comprising the step of providing cooperating holding means on said fitting and said adapter which serve as the sole means holding said electrical device in position.

* * * * *